US008026864B2

(12) United States Patent
Noro et al.

(10) Patent No.: US 8,026,864 B2
(45) Date of Patent: Sep. 27, 2011

(54) ANTENNA DEVICE, ANTENNA ELEMENT AND ANTENNA MODULE

(75) Inventors: Junichi Noro, Akita (JP); Hisashi Takisawa, Akita (JP); Takao Kato, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 198 days.

(21) Appl. No.: 11/829,353

(22) Filed: Jul. 27, 2007

(65) Prior Publication Data

US 2008/0055184 A1 Mar. 6, 2008

(30) Foreign Application Priority Data

Sep. 1, 2006 (JP) ..... P2006-237597

(51) Int. Cl.
*H01Q 1/38* (2006.01)

(52) U.S. Cl. ..... 343/872; 343/700 MS; 343/846

(58) Field of Classification Search ..... 343/700 MS, 343/702, 713, 846, 872, 878, 880, 882, 841, 343/848, 829, 853
See application file for complete search history.

(56) References Cited

U.S. PATENT DOCUMENTS 6,697,019 B1 * 2/2004 Hyuk-Joon et al. ... 343/700 MS
6,809,686 B2 * 10/2004 Du et al. ..... 343/700 MS
6,975,272 B2 * 12/2005 Yuanzhu ..... 343/700 MS
7,046,199 B2 * 5/2006 Montgomery et al. 343/700 MS
7,068,238 B2 * 6/2006 Yoneya et al. ..... 343/872
7,075,490 B2 * 7/2006 Noro ..... 343/713
7,129,906 B2 * 10/2006 Yoneya et al. ..... 343/872
7,327,328 B2 * 2/2008 Yoneya et al. ..... 343/841
7,339,538 B2 * 3/2008 Yoneya et al. ..... 343/713
7,436,366 B2 * 10/2008 Takisawa et al. ..... 343/711

FOREIGN PATENT DOCUMENTS

| | | |
|---|---|---|
| JP | 06-41219 | 5/1994 |
| JP | 7-106844 | 4/1995 |
| JP | 2001-24428 | 1/2001 |
| JP | 2002-303126 | 10/2002 |
| JP | 2003-46323 | 2/2003 |
| JP | 2005-12743 | 1/2005 |
| JP | 2005-109687 | 4/2005 |
| JP | 2006-121219 | 5/2006 |
| JP | 2006-197265 | 7/2006 |

OTHER PUBLICATIONS

Japanese Office Action with English Translation Issued Mar. 9, 2011.

* cited by examiner

*Primary Examiner* — Douglas W Owens
*Assistant Examiner* — Chuc D Tran
(74) *Attorney, Agent, or Firm* — Whitham Curtis Christofferson & Cook, PC

(57) ABSTRACT

An antenna element includes: an antenna plate; an antenna probe formed monolithically with the antenna plate and extending in a vertical direction from the antenna plate; a ground plate disposed in parallel to the antenna plate at a distance; and a dielectric spacer disposed between the antenna plate and the ground plate, wherein the antenna probe is bent from an edge of the antenna plate toward a center thereof.

3 Claims, 2 Drawing Sheets

ANTENNA DEVICE, ANTENNA ELEMENT AND ANTENNA MODULE

BACKGROUND

1. Technical Field

The present invention relates to an antenna device receiving an SDARS signal sent from an SDARS satellite, and more particularly, to an antenna element and an antenna module used for the antenna device.

2. Related Art

Recently, as known in the technical field, various antennas are mounted on vehicles such as an automobile. For example, an antenna for SDARS (Satellite Digital Audio Radio Service) is used as such an antenna.

The SDARS (Satellite Digital Audio Radio Service) is a digital broadcasting service using a satellite (hereinafter, referred to as "SDARS satellite") in the United States. That is, in the United States, a digital radio receiver receiving a satellite wave or a terrestrial wave from the SDARS satellite to provide digital radio broadcasting has been developed and put in practical use. Currently, in the United States, two broadcasting stations of XM and Sirius have provided radio programs more than total 250 channels throughout the whole country. The digital radio receiver is generally mounted in a mobile object such as an automobile, receives the electric wave in the frequency band of about 2-3 GHz, and provides the radio broadcasting. That is, the digital radio receiver is a radio receiver capable of providing the mobile broadcasting. Since the frequency of the reception electric wave is about 2.3 GHz, the reception wavelength (resonance wavelength) $\lambda$ at that time is about 128.3 mm. The terrestrial wave is formed in the manner that the satellite wave is received by an earth station, the frequency of the received satellite wave is slightly shifted, and the wave is re-sent in a linearly-polarized wave. That is, the satellite wave is a circular-polarized wave, but the terrestrial wave is the linearly-polarized wave.

The antenna device for XM satellite radio receives the circular-polarized electric wave from two geostationary satellites, and receives the electric wave by using terrestrial linear-polarized equipments in a blind zone. Meanwhile, the antenna device for Sirius satellite radio receives the circular-polarized electric wave from three orbiting satellites (synchro type), and receives the electric wave by the use of the terrestrial linear-polarized equipments in the blind zone.

Since the electric wave in the frequency band of about 2.3 GHz is used in such digital radio broadcasting, an antenna device receiving the electric wave is required to be installed outdoors. Accordingly, in order to mount the digital radio receiver in the mobile object such as the automobile, the antenna device is required to be mounted on the roof of the mobile object.

As the SDARS antenna, a planar antenna such as a patch antenna and a metal-plate loop antenna is used.

As the metal-plate loop antenna, there was well known a planar antenna in which distances from one another among an upper case, a planar antenna element, and a ground plate are kept and fixed accurately at predetermined distances (e.g., see Patent Document 1). The planar antenna disclosed in Patent Document 1 includes an upper case, a planar antenna element (metal-plate loop antenna) disposed on the back surface of the upper case at a predetermined distance, a ground plate disposed at a predetermined distance from the planar antenna element, an electrical conductor disposed between the planar antenna element and the ground plate, a circuit board attached to a lower surface of the ground plate, and electronic parts mounted on the circuit board. The electronic parts include a low noise amplifier (LNA). In the planar antenna element disclosed in Patent Document 1, there is a space between the planar antenna element and the ground plate, and an electromagnetic coupling type in which power is supplied to the planar antenna using the probe formed of the electrical conductor is employed.

Meanwhile, as the patch antenna, there was proposed "PATCH ANTENNA INCLUDING INTEGRAL PROBE" in which a conductive patch and a probe are physically coupled tightly (e.g., see Patent Document 2). In the patch antenna disclosed in Patent Document 2, a conductive patch includes an integral probe. The probe has a substantially rectangular shape and extends in a direction substantially perpendicular to the surface of the conductive patch. The probe is produced as a part of the conductive patch by using any available metal processing work in addition to punching, piercing, perforating, shearing, and shaping. In the exemplary embodiment, the probe is shaped by punching the conductive patch connected thereto. In order to perform the punching work, the probe is left as an integral part of the conductive patch connected thereto. In the patch antenna disclosed in Patent Document 2, the probe is shaped by punching the conductive patch so as to be bent from the center of the conductive patch toward the outside thereof. A dielectric spacer is provided between the conductive patch and a conductive substrate having a ground surface on a main surface, and the probe extends through the dielectric spacer. In Patent Document 2, the conductive patch is just mounted on the dielectric spacer, but the conductive patch is not fixed to the spacer.

A GPS receiving antenna suitable to be installed outside the vehicle is known (e.g., Patent Document 3). The antenna device disclosed in Patent Document 3 includes an antenna case formed by attaching a top cover and a bottom plate to each other, an antenna module which is housed in the top cover and receives a GPS signal, and a packing member which is disposed in the joint portion between the top cover and the bottom plate to seal the antenna module. The antenna module includes an antenna element for receiving a GPS signal sent from a GPS satellite, a circuit board on which a processing circuit for performing various signal processes such as amplification in signal for the GPS signal received by the antenna element is formed, and a shield case for shielding the processing circuit. The antenna element and the circuit board are attached to each other by a double-sided adhesive tape or the like.

Patent Document 1; JP-A-2001-24428
Patent Document 2: JP-A-7-106844
Patent Document 3: JP-A-2005-109687

In the above-described the metal-plate loop antenna disclosed in Patent Document 1, there is an air gap between the planar antenna element and the ground plate. For the reason, the metal-plate loop antenna disclosed in Patent Document 1 does not have an effect to shorten wavelength in case using a dielectric, thereby increasing size.

In the patch antenna disclosed in Patent Document 2, the probe is shaped by punching the conductive patch so that the probe is bent from the center of the conductive patch to the outside (toward the edge of the conductive patch) thereof. For the reason, the width between the bent portion (base of the probe) and the edge (side) of the conductive patch becomes smaller. As a result, when the probe is bent, the bent portion may be deformed. Further, in the patch antenna disclosed in Patent Document 2, since the conductive patch and the dielectric spacer are not fixed, there is a problem in that assembly is difficult.

In Patent Document 3, the antenna element is disclosed, but any detail configuration thereof is not disclosed.

SUMMARY

An advantage of some aspects of the invention is to provide an antenna element in which an antenna plate is not deformed in spite of bend of an antenna probe, an antenna module including the same, and an antenna device including the same.

Another advantage of some aspects of the invention is to provide an antenna module which can be easily assembled and an antenna device including the same.

The advantages can be attained by at least one of the following aspects:

According to a first aspect of the invention, there is provided an antenna element including: an antenna plate (131); an antenna probe (132) formed monolithically with the antenna plate and extending in a vertical direction from the antenna plate; a ground plate (134) disposed in parallel to the antenna plate at a distance; and a dielectric spacer (133) disposed between the antenna plate and the ground plate. The antenna probe (132) is bent from the edge (131*b*) of the antenna plate toward the center thereof.

The antenna element may further include a fixing member (137, 138), fixing the antenna plate (131), the ground plate (134), and the dielectric spacer (133). The fixing member may include a plurality of screws (137, 138). The antenna element may be an element adapted to receive an SDARS signal.

According to a second aspect of the invention, there is provided an antenna module (13) including: an antenna element adapted to receive a signal; a circuit board (135) having a processing circuit for processing the signal received by the antenna element mounted thereon; and a shield case (136), shielding the processing circuit. The antenna element includes an antenna plate (131), an antenna probe (132) which is formed monolithically with the antenna plate and extends in a vertical direction from the antenna plate and a front end (132*b*) of which is connected to the circuit board, a ground plate (134) disposed in parallel to the antenna plate at a distance, and a dielectric spacer (133) disposed between the antenna plate and the ground plate. The antenna probe (132) is bent from the edge (131*b*) of the antenna plate (131) toward the center thereof.

The antenna module (13) may further include a fixing member (137, 138), fixing the antenna plate (131), the ground plate (134), and the dielectric spacer (133). The fixing member may include a plurality of screws (137, 138). The antenna module (13) may have a double-sided adhesive tape (139), attaching the antenna element (131 to 134) and the circuit board (135) to each other. The antenna module (13) may be a module adapted to receive an SDARS signal as the signal.

According to a third aspect of the invention, there is provided an antenna device (10) including: an antenna case including a top cover (11) and a bottom plate (12) attached to each other; an antenna module (13) housed in the top cover and including an antenna element adapted to receive a signal; a packing member (14) disposed at the joint portion between the top cover and the bottom plate to seal the antenna module; and a plurality of screws (17), fixing the bottom plate to the top cover with the packing member interposed therebetween. The antenna module (13) includes the antenna element (131 to 134); a circuit board (135) having a processing circuit for processing the signal received by the antenna element mounted thereon; and a shield case (136), shielding the processing circuit. The antenna element includes an antenna plate (131), an antenna probe (132) which is formed monolithically with the antenna plate and extends in a vertical direction from the antenna plate and a front end of which is connected to the circuit board, a ground plate (134) disposed in parallel to the antenna plate at a distance, and a dielectric spacer (133) disposed between the antenna plate and the ground plate. The antenna probe (132) is bent from the edge (131*b*) of the antenna plate (131) toward the center thereof.

The antenna device (10) may further include a fixing member (137, 138), fixing the antenna plate (131), the ground plate (134), and the dielectric spacer (133). The fixing member may include a plurality of screws (137, 138). The antenna module (13) may have a double-sided adhesive tape (139), attaching the antenna element (131 to 134) and the circuit board (135) to each other. The antenna device (10) may be a device adapted to receive an SDARS signal as the signal.

Reference numerals in the parentheses are given to easily understand the invention, but are not limited thereto.

In the invention, since the antenna probe is bent from the edge of the antenna plate toward the center thereof, the width between the bent portion (base of the antenna probe) and the edge of the antenna plate is sufficiently large. As a result, even when the antenna probe is bent, the antenna plate is not deformed in the bent portion. In addition, since the antenna plate, the ground plate, and the dielectric spacer are fixed by the fixing member, the antenna element can be handled as a single part. Consequently, the antenna module or the antenna device can be easily assembled.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of the invention will be described in detail with reference to the drawings.

Figure 1:
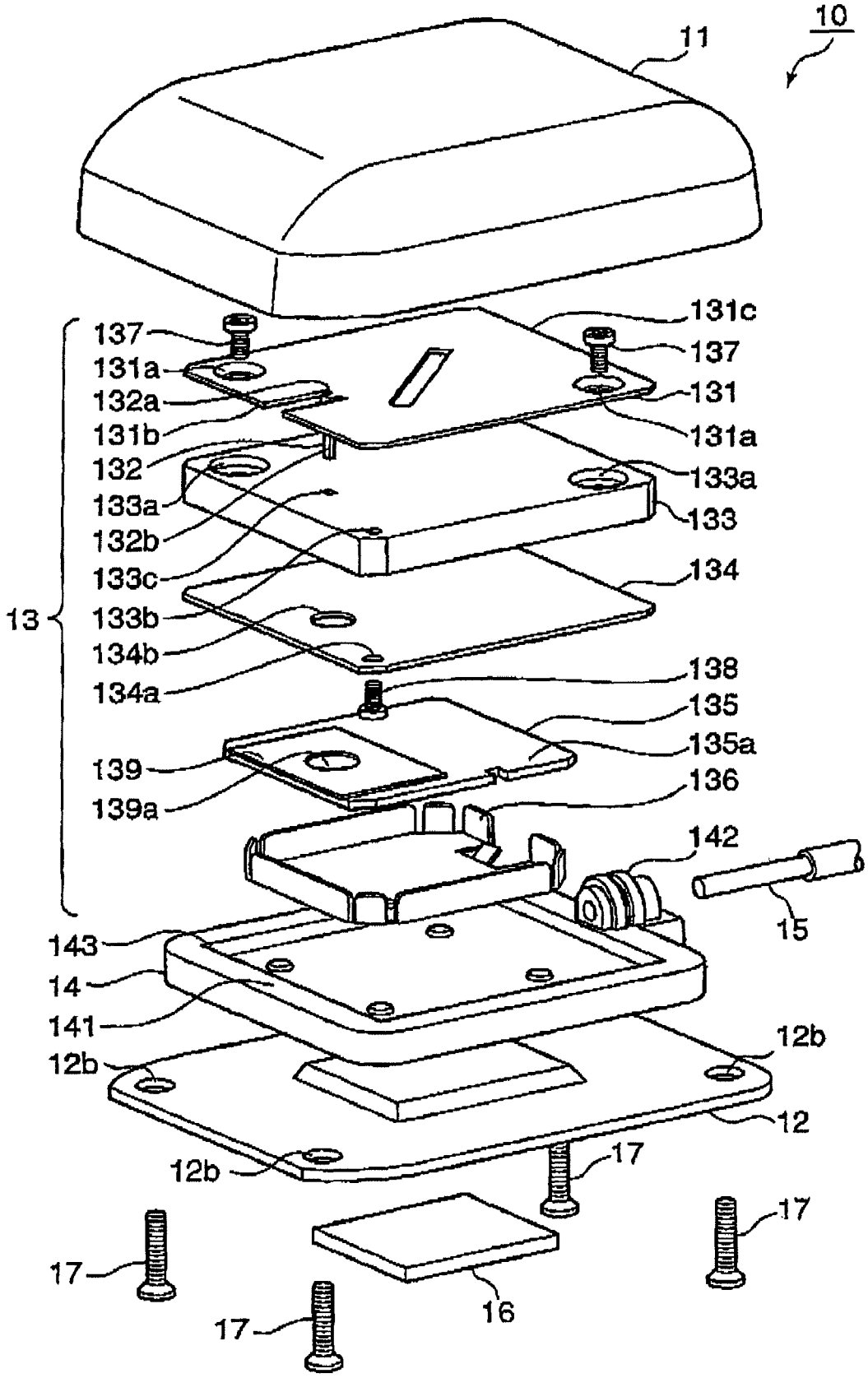
FIG. 1 is an exploded perspective view of an antenna device according to an exemplary embodiment of the invention as viewed from the upper portion.
Figure 2:
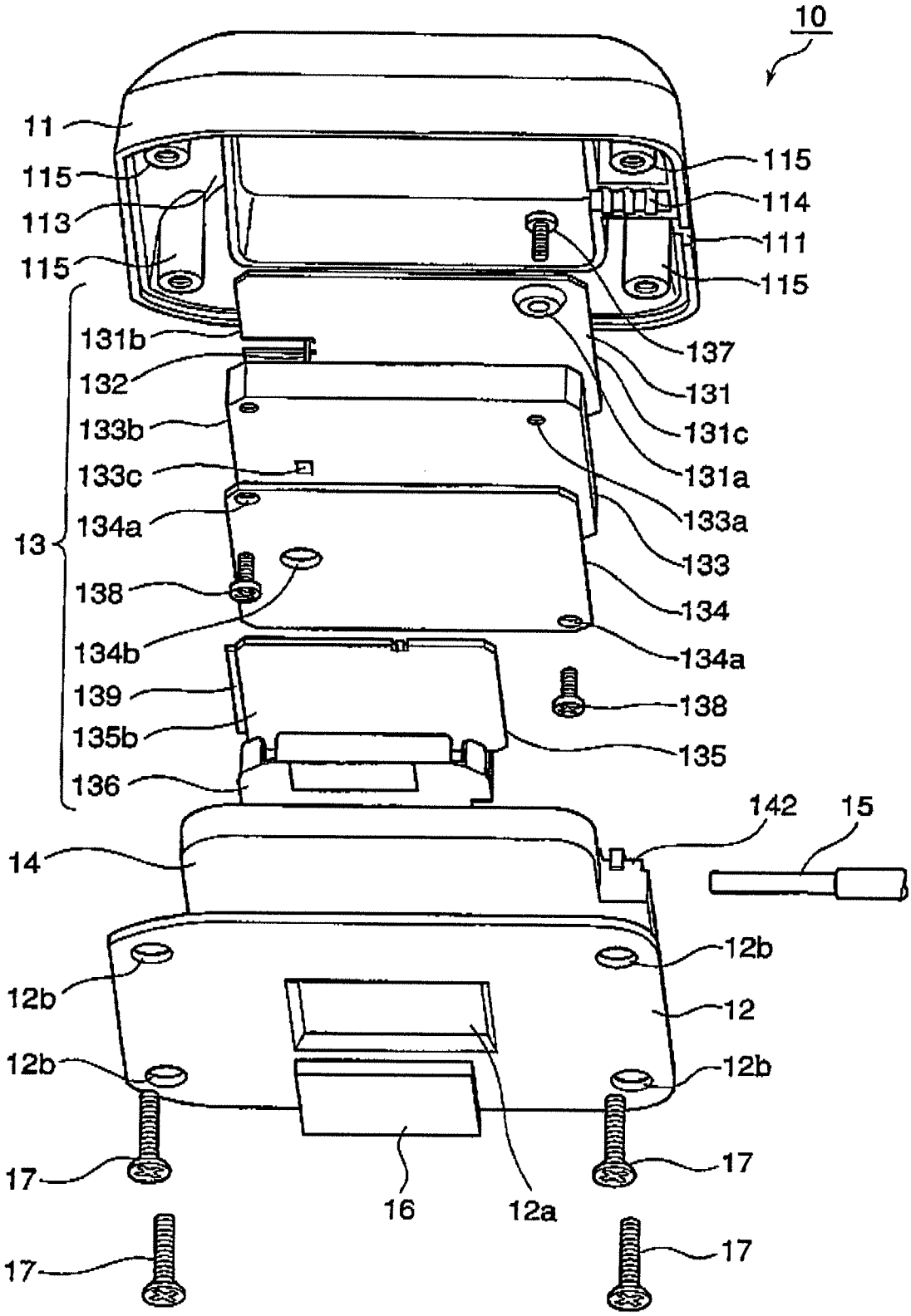
FIG. 2 is an exploded perspective view of the antenna device shown in FIG. 1 as viewed from the lower portion.

An antenna device 10 according to an exemplary embodiment of the invention will be described with reference to FIGS. 1 and 2. FIG. 1 is an exploded perspective view of the antenna device 10 as viewed from the upper portion, and FIG. 2 is an exploded perspective view of the antenna device 10 as viewed from the lower portion. The shown antenna device 10 is an antenna device for receiving an SDARS signal sent from an SDARS satellite.

The antenna device 10 includes a dome-shaped top cover 11, a bottom plate 12, an antenna module 13 disposed in the top cover 11, a packing member 14, a signal line 15, and a permanent magnet 16. The top cover 11 and the bottom plate 12 are assembled by four screws 17 and thus constitute an antenna case.

The packing member 14 is formed of, for example, resin materials such as silicon rubber and EPDM rubber (ethylene propylene rubber). The packing member 14 is disposed at the joint portion between the top cover 11 and the bottom cover 12 to ensure sealing of the antenna case. Since the packing member 14 has a waterproof function, the packing member 14 is called as a waterproof packing. The signal line 15 is connected to the antenna module 13. The packing member 14 will be described below in more detail.

The antenna module 13 includes an antenna plate 131, an antenna probe 132, a dielectric spacer 133, a ground plate 134, a circuit board 135, and a shield case 136.

The ground plate 134 is made of metal and has a substantially rectangular shape. The antenna plate 131 is made of metal and has a substantially rectangular shape. The antenna plate 131 serves as a metal-plate loop antenna element. The antenna plate 131 is opposed to the ground plate 134 at a predetermined distance, with a dielectric spacer 133 interposed therebetween. The dielectric spacer 133 is made of ABS resin and has a substantially rectangular shape.

The antenna plate 131 has a pair of screw penetration holes 131*a* in a pair of corner portions opposed to a first diagonal. The dielectric spacer 133 has a pair of screw penetration holes 133*a* in positions corresponding to the pair of screw penetration holes 131*a*. Two screws 137 are coupled with the pair of screw penetration holes 131*a* of the antenna plate 131 and the pair of screw penetration holes 133*a* of the dielectric spacer 133 to fix the antenna plate 131 and the dielectric spacer 133 to each other.

The ground plate 134 has a pair of screw penetration holes 134*a* in a pair of corner portions opposed to a second diagonal extending in a direction across the first diagonal. The dielectric spacer 133 has a pair of screw penetration holes 133*b* in positions corresponding to the pair of screw penetration holes 134*a*. Two screws 138 are coupled with the pair of screw penetration holes 134*a* of the ground plate 134 and the pair of screw penetration holes 133*b* of the dielectric spacer 133 to fix the ground plate 134 and the dielectric spacer 133 to each other.

As described above, the antenna plate 131, the dielectric spacer 133, and the ground plate 134 are fixed to one another by the four screws 137 and 138 to be handled as a single part. Accordingly, the four screws 137 and 138 serve as a fixing member for fixing the antenna plate 131, the dielectric spacer 133, and the ground plate 134. The antenna probe 132 is integrated with the antenna plate 131. The antenna plate 131, the antenna probe 132, the dielectric spacer 133, and the ground plate 134 constitute an antenna element. That is, since the antenna element can be handled as a single part, the antenna module 13 or the antenna device 10 can be easily assembled.

Each area of the surfaces of the ground plate 134 and the antenna plate 131 is smaller than that of the above-described Patent Document 1. When the ground plate and the antenna plate become small in size, the electrostatic capacity of the antenna element may decrease. Accordingly, the antenna device may not have sufficient gain. However, in the antenna device 10 of the invention, since the dielectric spacer 133 is interposed between the ground plate 134 and the antenna plate 131, relative permittivity between the ground plate 134 and the antenna plate 131 increases to secure sufficient electrostatic capacity. For the reason, the antenna device 10 of the invention has high gain. Specifically, the dielectric spacer 133 between the ground plate 134 and the antenna plate 131 has the substantially same size as the areas opposed to the ground plate 134 and the antenna plate 131. That is, most of the space between the ground plate 134 and the antenna plate 131 is filled with the dielectric spacer 133 made of resin materials. Since the resin has higher relative permittivity higher than air does, the antenna element has sufficient electrostatic capacity.

The antenna probe 132 is integrated with the antenna plate 131. The antenna probe 132 has a substantially rectangular shape and extends substantially perpendicular to the surface of the antenna plate 131. The antenna probe 132 is shaped by punching the antenna plate 131 connected thereto. The antenna probe 132 is left as an integral part of the antenna plate 131 connected thereto. The shown antenna probe 132 is bent from the edge (one side) of the antenna plate 131 toward the center thereof. For the reason, the width between the bent portion (base of the probe) 132*a* and the opposite edge (side) 131*c* of the antenna plate 131 is large enough. As a result, even when the antenna probe 132 is bent, the bent portion of the antenna plate 131 is not deformed.

The dielectric spacer 133 has a probe penetration hole 133*c* through which the antenna probe 132 passes. The ground plate 134 has an opening hole 134*b* through which the antenna probe 132 loosely passes. In addition, a double-sided adhesive tape 139 also has an opening hole 139*a* through which the antenna probe 132 loosely passes. The antenna probe 132 passes through the probe penetration hole 133*c* of the dielectric spacer 133, the opening hole 134*b* of the ground plate 134, and the opening hole 139*a* of the double-sided adhesive tape 139. A front end portion 132*b* of the antenna probe 132 is electrically connected to a circuit board 135.

The antenna element receives the SDARS signal sent from the SDARS satellite. A circuit (hereinafter, referred to as processing circuit) performing various signal processes such as signal amplification for the SDARS received by the antenna element is formed on a back surface 135*b* of the circuit board 135. The antenna element (ground plate 134) and the surface 135*a* of the circuit board 135 are attached to each other by the double-sided adhesive tape 139.

The circuit board 135 is connected to a signal line 15 for drawing the SDARS signal out of the antenna case (top cover 11 and bottom plate 12). A shield case 136 for shielding the processing circuit is attached to the back surface of the circuit board 135 by soldering. The signal line 15 is drawn out through a notch portion (described below) from in the top cover 11.

In a state where the antenna module 13 and the packing member 14 are housed in the internal space of the top cover 11, the top cover 11 and the bottom plate 12 are fixed by the four screws 17, thereby integrating the antenna device 10.

The packing member 14 is made of, for example, resin materials such as silicon rubber and EPDM rubber. The packing member 14 includes a base portion 141 covering the whole antenna module 13, a gasket portion (bush portion) 142 covering the outer circumference of the signal line 15 in the notched portion (described below) formed in the top cover 11, and a frame portion 143 formed in the outer circumference of the base portion 141. Since the packing member 14 is monolithically constituted by the base portion 141, the gasket portion (bush portion) 142, and the frame portion 143, the number of parts and the number of working processes become smaller than the number of parts and the number of working processes in a case where each portion is individual part. Accordingly, the packing member 14 is useful for decrease in size, decrease in weight, reliability, and low cost.

Meanwhile, a single concave portion 12*a* is formed in the center portion of the bottom plate 12. A permanent magnet 16 is disposed in the concave portion 12*a*. The permanent magnet 16 is disposed so that the antenna device 10 is attached and fixed to the roof of the automobile. Though not shown, a resin sheet for preventing the roof of the automobile from being damaged is attached to the outward main surface of the bottom plate 12 throughout the substantially whole main surface. A model number, a name, or the like of the antenna device 10 is printed on the resin sheet.

Next, the configuration of the top cover 11 will be described with reference to FIG. 2. The top cover 11 has a notch portion 111. A waterproof rib 113 protruding in a substantially angled-frame shape is formed in the top cover 11. The waterproof rib 113 is formed corresponding to the frame portion 143 of the packing member 14. The top cover 11 has a gasket accommodating portion 114 for accommodating the gasket portion 142, and four screw bosses 115 for coupling the four screws 17, respectively. The four screw bosses 115 protrude from the inner wall of the top cover 11 toward the bottom plate 12.

In the bottom plate 12, four screw penetration holes 12*b* through which the four screws 17 passes are formed at portions corresponding to the four screw bosses 115.

In the antenna device 10 with such a configuration, a waterproof structure is employed. That is, in the waterproof structure of the antenna device 10, the four screws 17 are coupled with the four screw bosses 115 of the top cover 11 through the four screw penetration holes of the bottom plate 12, and thus the top cover 11 is coupled with the bottom plate 12 by screws, with the packing member 14 interposed therebetween. Accordingly, the frame portion 143 of the packing member 14 is pressed by the waterproof rib 113 of the top cover 11 with the screw coupling pressure, thereby functioning the waterproof. In the protruding portion of the signal line is, the gasket portion (bush portion) 142 of the packing member 14 is fitted into the gasket accommodating portion 114 of the top cover 11 to make the waterproof.

The exemplary embodiment according to the invention was described above, but the invention is not limited to the above-described exemplary embodiment. For example, in the above-described exemplary embodiment, the plurality of screws are used as the fixing member for fixing the antenna plate, the ground plate, and the dielectric spacer, but the fixing member is not limited to the screws. In addition, the antenna device described in the exemplary embodiment is suitable for the SDARS-signal receiving antenna device, but is not limited thereto. That is, the antenna according to the exemplary embodiment may be employed as the GPS-signal receiving antenna device, the mobile communicating antenna device for receiving the satellite or terrestrial wave, or the like.

The entire disclosure of Japanese Patent Application No 2006-237597, filed on Sep. 1, 2006 is expressly incorporated by reference herein.

While this invention has been described in conjunction with the specific embodiments thereof, it is evident that many alternatives, modifications, and variations will be apparent to those skilled in the art. Accordingly, exemplary embodiments of the invention as set forth herein are intended to be illustrative, not limiting. There are changes that may be made without departing from the sprit and scope of the invention.

What is claimed is:

1. An antenna device comprising:

an antenna case including a top cover and a bottom plate attached to each other;

an antenna module housed in the top cover and adapted to receive a signal; and a packing member disposed at a joint portion between the top cover and the bottom plate to seal the antenna module;

wherein the antenna module includes:

an antenna element, a circuit board on which a processing circuit for processing the signal received by the antenna element is mounted, and a shield case, shielding the processing circuit, wherein the antenna element includes:

an antenna plate having a flat plate shape, an antenna probe formed monolithically with the antenna plate by bending from a peripheral edge to a center of the antenna plate and extending in a vertical direction an end of which is connected to the processing circuit, a ground plate having a flat plate shape and disposed in parallel to the antenna plate at a distance, and a dielectric member, made of a resin material, disposed between the antenna plate and the ground plate so as to fill most of a space between the antenna plate and the ground plate, and formed with a through hole through which the antenna probe is inserted, wherein the packing member includes:

a base covering the antenna module, and a frame formed around a circumference of the base, and wherein the antenna element is formed by fixing the antenna plate and the ground plate to the dielectric member by screws, the antenna module is formed by connecting the ground plate to the circuit board and attaching the shield case to the circuit board by soldering after forming the antenna element, the top cover and the bottom plate are screwed to each other in a state where the antenna module and the packing member are housed in an inner space of the top cover.

2. The antenna device according to claim 1, wherein the antenna module further includes a double-sided adhesive tape, attaching the antenna element and the circuit board to each other.

3. The antenna device according to claim 1, wherein the antenna device is a device adapted to receive an SDARS signal as the signal.

* * * * *